US006210229B1

(12) United States Patent
Lai

(10) Patent No.: US 6,210,229 B1
(45) Date of Patent: Apr. 3, 2001

(54) SHIELDED CABLE CONNECTOR ASSEMBLY

(75) Inventor: Chin-Te Lai, Tao-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/324,356

(22) Filed: Jun. 2, 1999

(30) Foreign Application Priority Data

Dec. 31, 1998 (TW) ..... 87222066

(51) Int. Cl.[7] ..... H01R 9/03
(52) U.S. Cl. ..... 439/610
(58) Field of Search ..... 439/610, 607, 439/358, 76.1, 76.2, 493, 357

(56) References Cited

U.S. PATENT DOCUMENTS 5,195,909 * 3/1993 Huss, Jr. et al. ..... 439/465
5,797,771 * 8/1998 Garside ..... 439/610
5,836,774 * 11/1998 Tan et al. ..... 439/76.1
5,899,772 * 5/1999 Beaver et al. ..... 439/610
5,934,942 * 8/1999 Patel et al. ..... 439/610

* cited by examiner

*Primary Examiner*—Khiem Nguyen
*Assistant Examiner*—Michael C. Zarroli
(74) *Attorney, Agent, or Firm*—Wei Te Chung

(57) ABSTRACT

A shielded cable assembly includes a housing having a front face, a rear face and a number of passageways defined through the faces, a number of contacts received in the passageways, a grounding shield, a nose shield, a cable having several wires therein, a circuit trace board forming a number of conductive pads thereon for soldering ends of the contacts and wires thereto, an upper shell, and a lower shell. One edge of the circuit trace board is received in the rear face of the housing. A pair of tabs upwardly extends from opposite ends of an outer edge of the grounding shield. The housing further includes a top face, a bottom face, and two sidefaces. A pair of niches is disposed between the housing and the nose shield for receiving the tabs of the grounding shield. The tabs securely abut against the nose shield to discharge accumulated charges thereby ensuing proper signal transmission.

8 Claims, 3 Drawing Sheets

SHIELDED CABLE CONNECTOR ASSEMBLY

BACKGROUND OF THE INVENTION

The present invention relates to a connector, and especially to a shielded cable connector assembly.

U.S. Pat. Nos. 5,092,794 and 5,417,590 disclose two kinds of shielded cable connector assemblies. Each assembly includes a first shield, a second shield, a housing, a plurality of contacts and a cable. A pair of tabs is provided at an edge of the first shield to abut against the second shield whereby charges can be transferred therebetween. The tabs are usually small and project a small angle away from the first shield. Thus, the tabs do not firmly abut against the second shield. As a result, discharge is hindered and the accumulated charges will adversely affect signal transmission. Hence, an improved shielded cable connector assembly is required to overcome the disadvantages of the prior art.

BRIEF SUMMARY OF THE INVENTION

An object of the present invention is to provide a shielded cable connector assembly having a grounding shield and a nose shield securely abutting against each other for ensuring proper discharge of accumulated charges resulting from electromagnetic interference.

Accordingly, a shielded cable assembly includes a housing having a front face, a rear face and a plurality of passageways defined through the faces, a plurality of contacts received in the passageways, a grounding shield, a nose shield, a cable having several wires therein, a circuit trace board forming a plurality of conductive pads thereon for soldering ends of the contacts and wires thereto, an upper shell, and a lower shell. One edge of the circuit trace board is received in the rear face of the housing. A pair of tabs upwardly extends from opposite ends of an outer edge of the grounding shield. The housing further includes a top face, a bottom face, and two sidefaces. A pair of niches is disposed between the housing and the nose shield for receiving the tabs of the grounding shield. The tabs securely abut against the nose shield to discharge accumulated charges thereby ensuing proper signal transmission.

Other objects, advantages and novel features of the invention will become more apparent from the following detailed description of the present embodiment when taken in conjunction with the accompanying drawings.

DETAILED DESCRIPTION OF THE INVENTION

Figure 1:
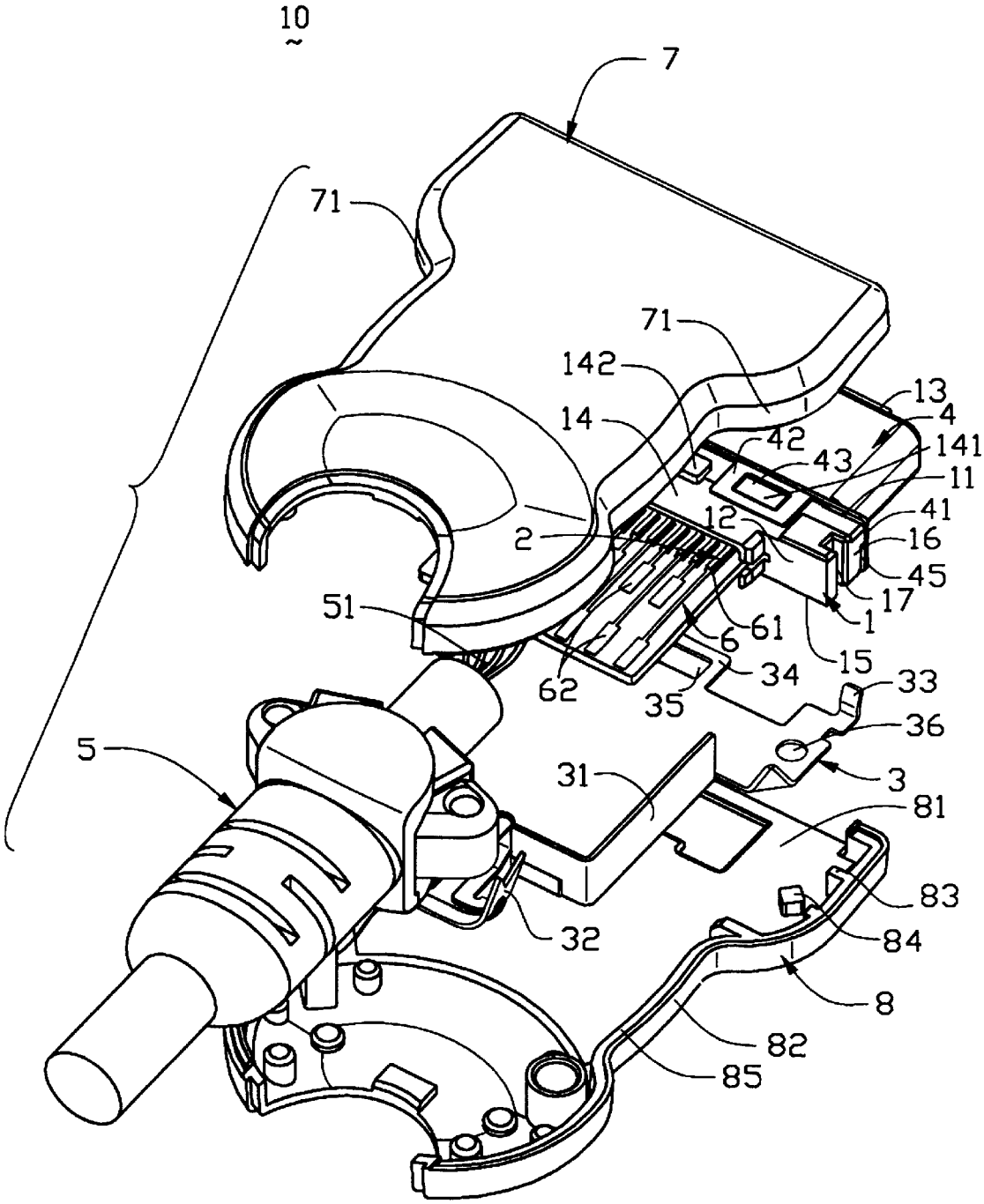
FIG. 1 is an exposed view of the present invention.
Figure 2:
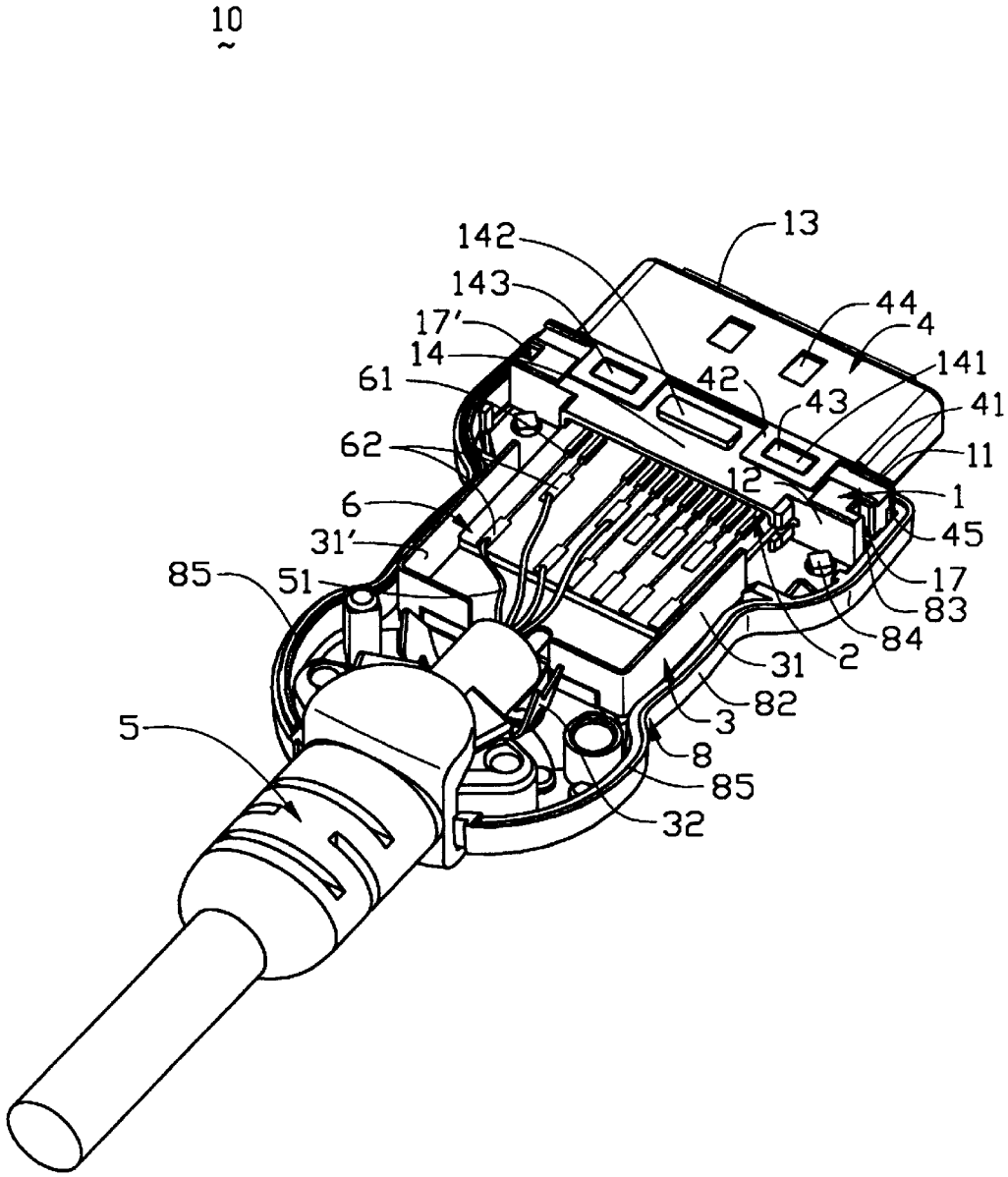
FIG. 2 is an assembled view of FIG. 1 with the upper shell removed therefrom.

Referring to FIGS. 1 and 2, a shielded cable connector assembly 10 includes a housing 1 having a front face 11, a rear face 12 and a plurality of passageways (not shown) defined through the faces 11, 12, a plurality of contacts 2 received in the passageways, a grounding shield 3 and a nose shield 4 respectively assembled to the back and front of the housing 1, a cable 5 having several wires 51 therein, a circuit trace board 6, which forms a plurality of conductive pads 61, 62 thereon for respectively soldering ends of contacts 2 and wires 51 thereto, assembled to the back of the housing 1, an upper shell 7 and a lower shell 8 encapsulating the elements described before therebetween.

The housing 1 has a mating portion 13 forwardly extending therefrom and covered by the nose shield 4 to engage with a mating connector (not shown). The housing 1 further includes a top face 14, a bottom face 15, and two sidefaces 16, 16'. Three upper embossments 141, 142, 143 are formed on the top face 14 and three lower embossments (not shown) are formed on the bottom face 15. A groove 17, 17' is defined in each sideface 16. A slot (not shown) is defined in the rear face 12 of the housing 1 for retaining an edge of the circuit trace board 6 therein.

The grounding shield 3 is stamped from a metal plate to have two sidewalls 31, 31' and a rearward extending bifurcated retainer 32 . A pair of tabs 33 upwardly extends from opposite ends of an outer edge of the grounding shield 3. An engaging portion 34 extends from the outer edge of the grounding shield 3 between the tabs 33 and defines an opening 35 therein.

Figure 3:
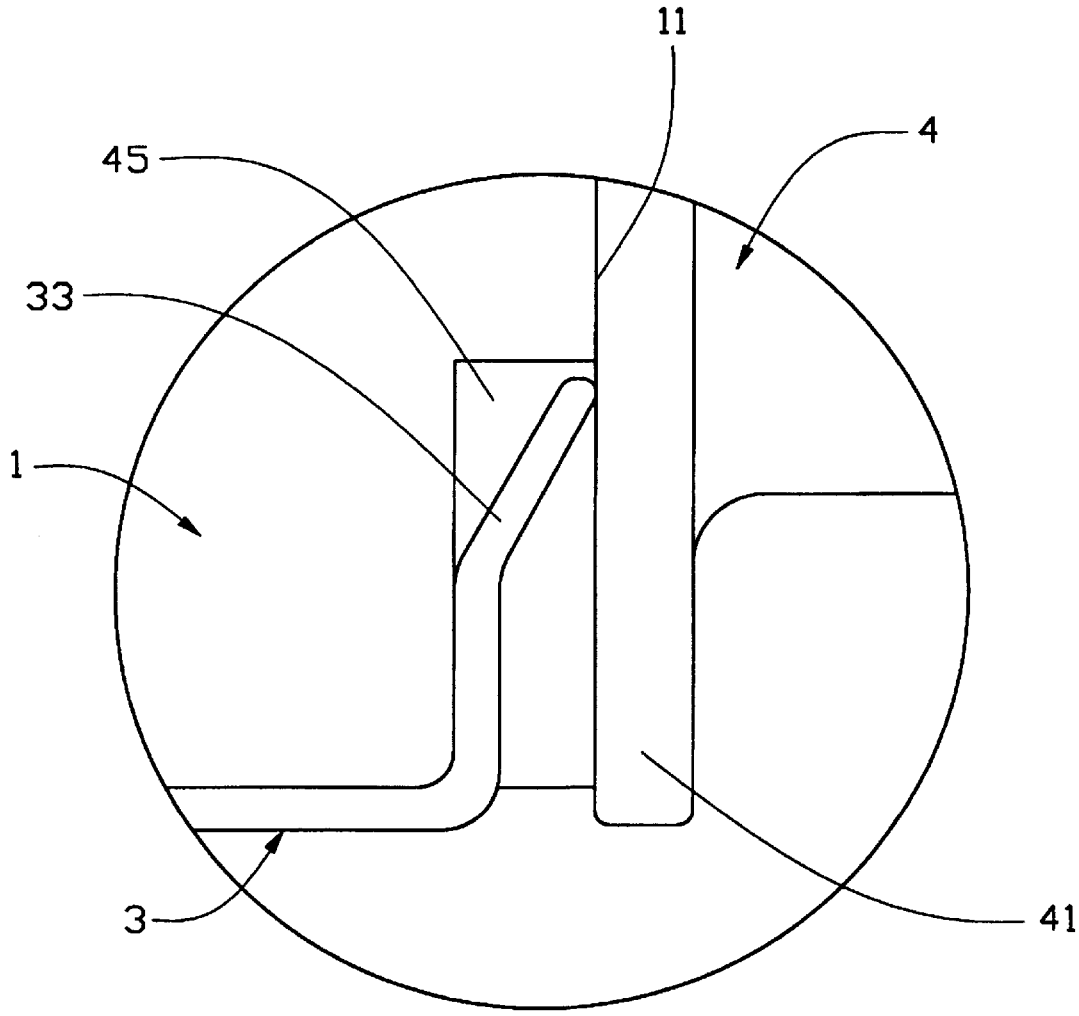
FIG. 3 is an enlarged partial view showing a tab of a grounding shield received in a niche between a housing and a nose shield.

An extending wall 41 projects from an end of the nose shield 4 opposite the front face 11 of the housing 1. A pair of extensions 42 perpendicularly extends from an edge of the extending wall 41. Each extension 42 defines a cavity 43 for engaging with the corresponding embossment 141, 143. A pair of protrusions 44 is provided in opposite faces of the nose shield 4 for contacting grounding portions of the mating connector (not shown). A pair of niches 45 is defined in the front face 11 between the housing 1 and the nose shield 4 and exposed to the bottom face 15 for receiving the corresponding tabs 33 of the grounding shield 3. The tabs 33 securely abut against the extending wall 41 of the nose shield 4 (FIG. 3).

The lower shell 8, which is manufactured from plastic material, includes a main plate 81, and a pair of flanges 82 upwardly extending from opposite sides of the main plate 81. A rib 83 is formed inwardly projecting from each flange 82 at predetermined position, and a pole 84 upwardly extends from the main plate 81 proximate each rib 83. A protruding edge 85 is provided along a top of each flange 82. The upper shell 7 is identical to the lower shell 8 except that a channel (not shown) is provided along a top of each flange 71 instead of a protruding edge 85. Thus, the upper shell 7 can be easily distinguished from the lower shell 8.

In assembly, the grounding shield 3 is positioned in the lower shell 8 and the poles 84 of the main plate 81 are received in the corresponding holes 36 of the grounding shield 3. The housing 1 together with the contacts 2, the nose shield 4 and the circuit trace board 6 is positioned on the grounding shield 3 and the ribs 83 of the lower shell 8 are received in the corresponding grooves 17 of the housing 1, the tabs 33 of the grounding shield 3 are received in the niches 45 of the housing 1, and the embossment 142 is received in the opening 35 of the grounding shield 3. The cable 5 is assembled to the lower shell 8 from a rear portion thereof. The ends of the wires 51 are electrically engaged with the corresponding conductive pads 62 of the circuit trace board 6, and the end of the cable 5 is constrained by the bifurcated retainer 32. The upper shell 7 is assembled to the lower shell 8 by engaging the protruding engages 85 of the lower shell 8 with the channels (not shown) of the upper shell 7.

Another shield (not shown) may be provided above the circuit trace board 6 to abut against the grounding shield 3. The shield may be identical to the grounding shield 3 without the tabs 33 provided thereon.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shielded cable connector assembly, comprising:

a housing including a top face, a bottom face, a pair of sidefaces, a front face, a rear face and a mating portion forwardly extending beyond the front face;

a plurality of contacts received in the housing with ends thereof extending beyond the rear face of the housing;

a nose shield enclosing the mating portion of the housing and having a wall outwardly extending from one edge thereof, the wall confronting the front face of the housing;

a grounding shield having at least a pair of tabs upwardly extending from opposite ends of a front edge thereof, the grounding shield being assembled to the housing and the tabs being sandwiched between the wall of the nose shield and the front face of the housing and contacting the wall of the nose shield in a plane perpendicular to the top face and the sidefaces of the housing;

a cable having several wires therein establishing electrical connection with corresponding contacts; and an upper shell and a lower shell encapsulating the housing and the grounding shield therebetween.

2. The shielded cable connector assembly as claimed in claim 1, wherein a pair of niches is defined in the front face of the housing and exposed to the bottom face of the housing for receiving the tabs of the grounding shield therein.

3. The shielded cable connector assembly as claimed in claim 2, wherein each tab has an angled free end extending toward and securely abutting against the wall of the nose shield.

4. The shielded cable connector assembly as claimed in claim 1, wherein:

at least one hole is provided at a predetermined position in the grounding shield; and a corresponding number of poles are provided on the lower shell to be received in the corresponding holes for retaining the grounding shield in the lower shell.

5. The shielded cable connector assembly as claimed in claim 1, wherein:

a pair of grooves is defined in the opposite sidefaces of the housing; and a pair of flanges is formed on opposite sides of the lower shell and a pair of ribs is formed inwardly projecting from the flanges, the ribs being received in the grooves of the housing.

6. A shielded cable connector comprising:

a housing including a front face, a rear face and a mating portion extending forward from the front face;

a plurality of contacts disposed within the housing;

a circuit board positioned on the rear face of the housing on which the contacts are mounted;

a nose shield enclosing the mating portion therein and including a wall extending therefrom;

a horizontal grounding shield including at least a tab vertically extending therefrom and engaging with the wall of the nose shield, the grounding shield defining at least a hole;

a cable having several wires connected to the circuit board for establishing electrical connection with corresponding contacts; and an upper shell and a lower shell encapsulating the housing and the grounding shield therebetween, one of said upper shell and said lower shell forming at least a pole thereon, wherein the grounding shield protectively shields the circuit board and the rear face of the housing, and the at least a hole of the grounding shield retainably accommodates the at least a pole, thereby being secured to the one of said upper shell and said lower shell.

7. The shielded cable connector as claimed in claim 6, wherein at least a niche is formed in the housing for receiving the corresponding tab of the grounding shield.

8. A shielded cable connector comprising:

a housing including a front face, a rear race and a mating portion extending from the front face, a niche recessed from the front face;

a plurality of contacts disposed within said housing;

a nose shield enclosing the mating portion therein and including a wall extending therefrom;

a horizontal grounding shield including at least a tab vertically extending therefrom and received within said niche and engaging the wall of the nose shield;

a cable having several wires respectively connecting to said corresponding contacts; and shell means encapsulating the housing.

* * * * *